US006412245B1

(12) United States Patent
Lane et al.

(10) Patent No.: US 6,412,245 B1
(45) Date of Patent: Jul. 2, 2002

(54) BUILDING MEMBER

(75) Inventors: Gerald Thomas Lane; Kerry Ronald Treloar; Cornelis La Grouw; Johannes La Grouw, Sr., all of Rotorua (NZ)

(73) Assignee: La Grouw Holdings Limited, Rotorua (NZ)

( * ) Notice: Subject to any disclaimer, the term of this patent is extended or adjusted under 35 U.S.C. 154(b) by 0 days.

(21) Appl. No.: 09/210,399

(22) Filed: Dec. 14, 1998

(30) Foreign Application Priority Data

Dec. 12, 1997 (NZ) ..... 329387
Apr. 16, 1998 (NZ) ..... 330205

(51) Int. Cl.[7] ..... E04B 2/00

(52) U.S. Cl. ..... 52/586.1; 52/586.2; 52/592.1; 52/592.6; 52/783.1; 52/404.3

(58) Field of Search ..... 52/578, 783.1, 52/793.1, 793.11, 794.1, 796.1, 798.1, 589.1, 590.1, 592.6, 404.3, 404.4, 588.1, 582.1, 586.1, 586.2, 585.1, 591.4, 592.1, 405.4, 405.1, 405.2, 424

(56) References Cited

U.S. PATENT DOCUMENTS 1,433,162 A * 10/1922 Sweetland ..... 108/60
2,332,081 A * 10/1943 Hunt et al. ..... 52/586.1
2,981,669 A * 4/1961 Brand et al. ..... 29/525
3,198,143 A * 8/1965 Biglieri ..... 108/26
4,019,298 A * 4/1977 Johnson, IV ..... 52/590.1
4,285,181 A 8/1981 Van Loghem et al. ..... 52/404
4,329,827 A * 5/1982 Thorn ..... 52/793
4,360,553 A * 11/1982 Landheer ..... 428/45
4,715,162 A * 12/1987 Brightwell ..... 52/729.4
4,852,322 A * 8/1989 McDermid ..... 52/404.3
4,854,103 A * 8/1989 Klym ..... 52/592.6
4,967,534 A * 11/1990 Lines ..... 52/729.4
5,267,425 A * 12/1993 Onysko et al. ..... 52/729.2
5,323,584 A * 6/1994 Scarlett ..... 52/729.4
5,493,839 A * 2/1996 Sax et al. ..... 52/793.11
5,653,080 A * 8/1997 Bergeron ..... 52/729.4
5,787,669 A * 8/1998 Bishop ..... 52/591.4
5,850,722 A * 12/1998 Yasui ..... 52/793.11
5,966,894 A * 10/1999 Crump, Jr. ..... 52/729.4

FOREIGN PATENT DOCUMENTS

NZ 185995 11/1979
NZ 210843 10/1989

* cited by examiner

*Primary Examiner*—Carl D. Friedman
*Assistant Examiner*—Jennifer I. Thissell
(74) *Attorney, Agent, or Firm*—Jacobson Holman, PLLC

(57) ABSTRACT

A building member is formed from a pair of spaced apart boards connected between the opposed faces by narrow connecting members which extend the length thereof. The edges of the connecting members are preferably retained within channels in the opposed faces of the wooden boards. The boards and the connecting members enclose an insulation space which may be filled with an insulation material. A selection of advantageous connection profiles is disclosed for the connection between the edge of the connecting member and the channel of a board. One of the boards may instead comprise an extruded siding, for example of aluminium or plastic, with a leg extending perpendicularly from the siding forming the connecting member. The building member may be constructed in a simple process and reduces wastage of material which often occurs in forming laminated solid timber building products while offering enhanced insulative properties.

23 Claims, 8 Drawing Sheets

BUILDING MEMBER

BACKGROUND OF THE INVENTION

1. Field of the Invention

Figure 1:
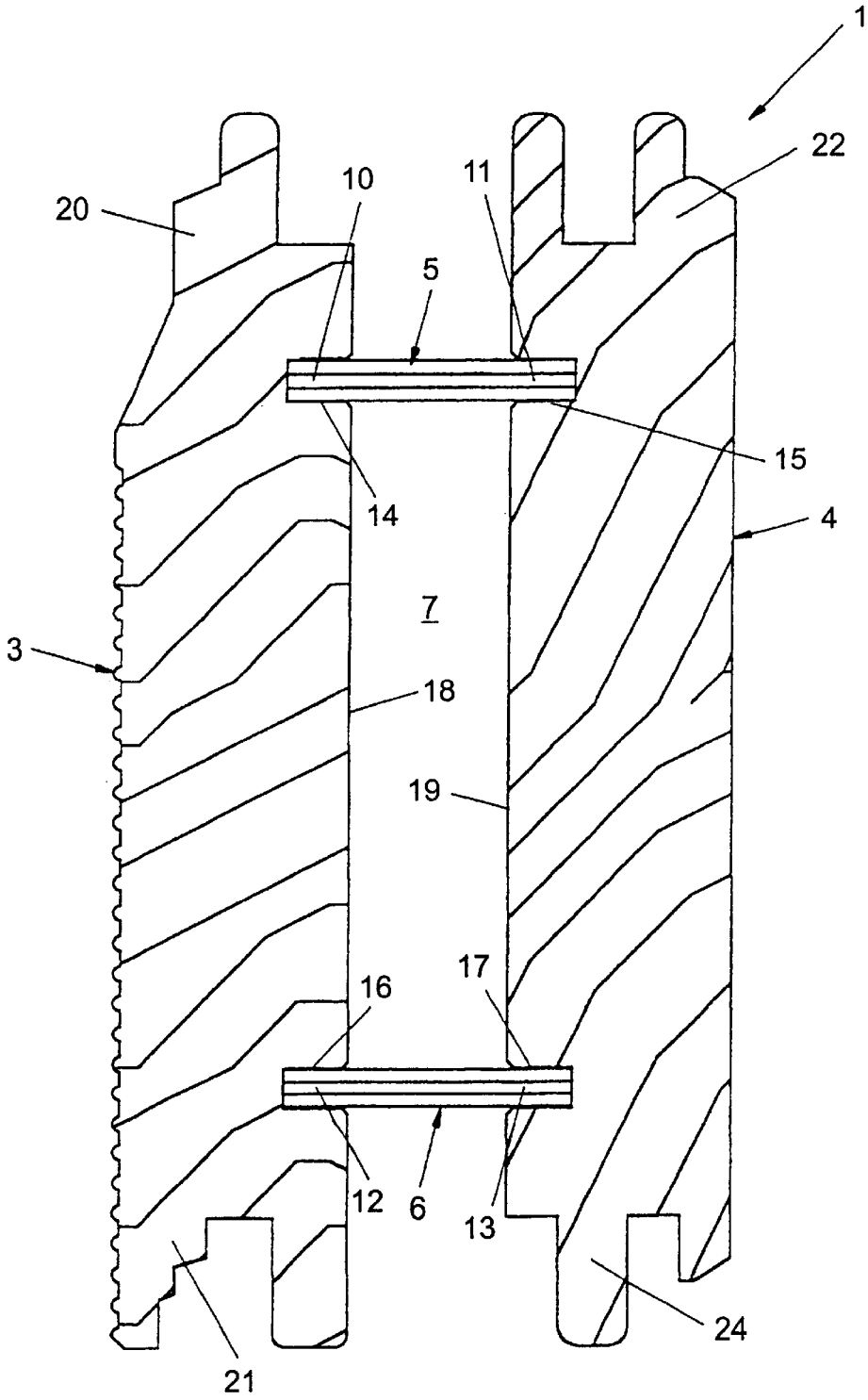

The present invention relates to building members and methods of constructing same and methods of building incorporating same. The invention particularly relates to wooden building members for construction of timber bases.

2. Description of the Prior Art

Houses have become popular incorporating a solid wood construction wherein the walls are constructed from a number of wall boards stacked edge to edge, usually with engaging connections such as tongue in groove connections therebetween. In solid timber homes the outer face of the wall boards represents the outer facing of the building and the inner face of the wall boards represents the inner facing of the building, and typically remains exposed without further lining. The boards are comparatively thick, for example up to 80 mm of timber bases.

Such constructions are strong and aesthetically pleasing. However, there is a growing importance being placed on household energy efficiency and consequently the thermal insulating properties of such constructions are now in question and do not meet some proposed standards. Attempts have been made to overcome this difficulty by providing an insulation space between two boards, the two boards and the insulation space being secured together to form the building member. One example of such a construction is shown in New Zealand Patent 185995 wherein the two wall boards are maintained in their separated arrangement by a plurality of transverse plastic webs. This construction is difficult and involves considerable expense to manufacture.

Another example is shown in New Zealand Patent application 210843/212940 wherein a pair of spaced apart boards are interconnected by a plurality of vertical spacers. This configuration also is difficult to manufacture and in particular makes it significantly more difficult to include an insulating material in the insulating space separating the two boards. Furthermore, the large vertical spacers reduce the effectiveness of the insulating gap as a whole.

In addition to the above disadvantages associated with the insulative properties of the boards, the constructions of the boards generally are complex. In particular the boards generally comprise a laminate of timber boards and as such each board must have its contacting surfaces carefully prepared, adhesives applied, and the boards assembled together. Once assembled together, the boards often must be kept in a pressed-together state until the adhesive has sufficiently cured. The exterior surfaces of the building member may then be dressed. This process tends to make the production of boards a series of discontinuous steps requiring substantial plant, with production capacity severely constrained by the plant available.

Therefore it is an object of the present invention to provide a building member or associated methods of construction thereof or therewith which will go some way towards overcoming the above disadvantages or will at least provide the industry with a useful choice.

In a first aspect the invention consists in a building member comprising spaced apart first and second members each having a pair of end faces defined by their depth and breadth, a pair of edges defined by their length and thickness and a pair of side faces defined by their length and depth, at least one said member comprising a board, a side face of said first member and a side face of said second member opposed and separated by an insulation space, and at least one connecting member bridging between said opposed side faces of said first and second members, and extending over substantially the entire length thereof, an edge of said connecting member being secured within a channel in and running the length of one said opposed side face and the other edge thereof being rigidly connected to the other said opposed side face to hold and secure said members in said spaced apart configuration.

In a second aspect the invention consists in a building member comprising first and second boards, each having a pair of end faces defined by their depth and breadth and four long faces, each defined by their length and thickness or their length and depth, a long face of said first board and a long face of said second board being opposed and abutting, and at least one connecting member bridging between said opposed long faces of said first and second board, and extending over substantially the entire length thereof, opposed edges of said connecting member being secured within channels in and running the length of said opposed long faces to hold and secure said boards in said abutting state notwithstanding the adhesion.

In a third aspect the invention consists in a building member substantially as herein described with reference to and as illustrated by any one or more of the accompanying drawings.

In a fourth aspect the invention consists in a method of constructing a building member from a pair of boards and at least one connecting member, the boards incorporating on faces thereof grooves to accommodate the edges of said at least one connecting member, characterised in that said method includes in no particular order, applying a wood soakable liquid into a corresponding said channel of each board, compressing at least the edge regions of said connecting member along the length thereof to be inserted within said channels, and inserting said edges of said connecting member into said corresponding channels such that in the presence of said wood soakable liquid said compressed edges are encouraged to swell and locate said edges securely within said channel.

In a fifth aspect the invention consists in a method of constructing a wall from building members as described in any one of the above paragraphs characterised in that said method includes stacking a plurality of said building members in an edge to edge configuration with edge faces of said first and second boards engaged with corresponding opposed edge faces of the first and second boards of adjacent building members, before stacking each further said building member placing a block of insulating material within the channel formed between said first and second boards, on top of the uppermost connecting member, and extending above the level of the upper edges of said first and second boards to protrude into the channel between the first and second boards of an upwardly adjacent building member to reach or nearly reach the lower connecting member thereof.

In a sixth aspect the invention consists in a building incorporating building members according to any one of the above paragraphs and/or constructed using a method as described above.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCIPTION OF THE DRAWINGS

Figure 2:
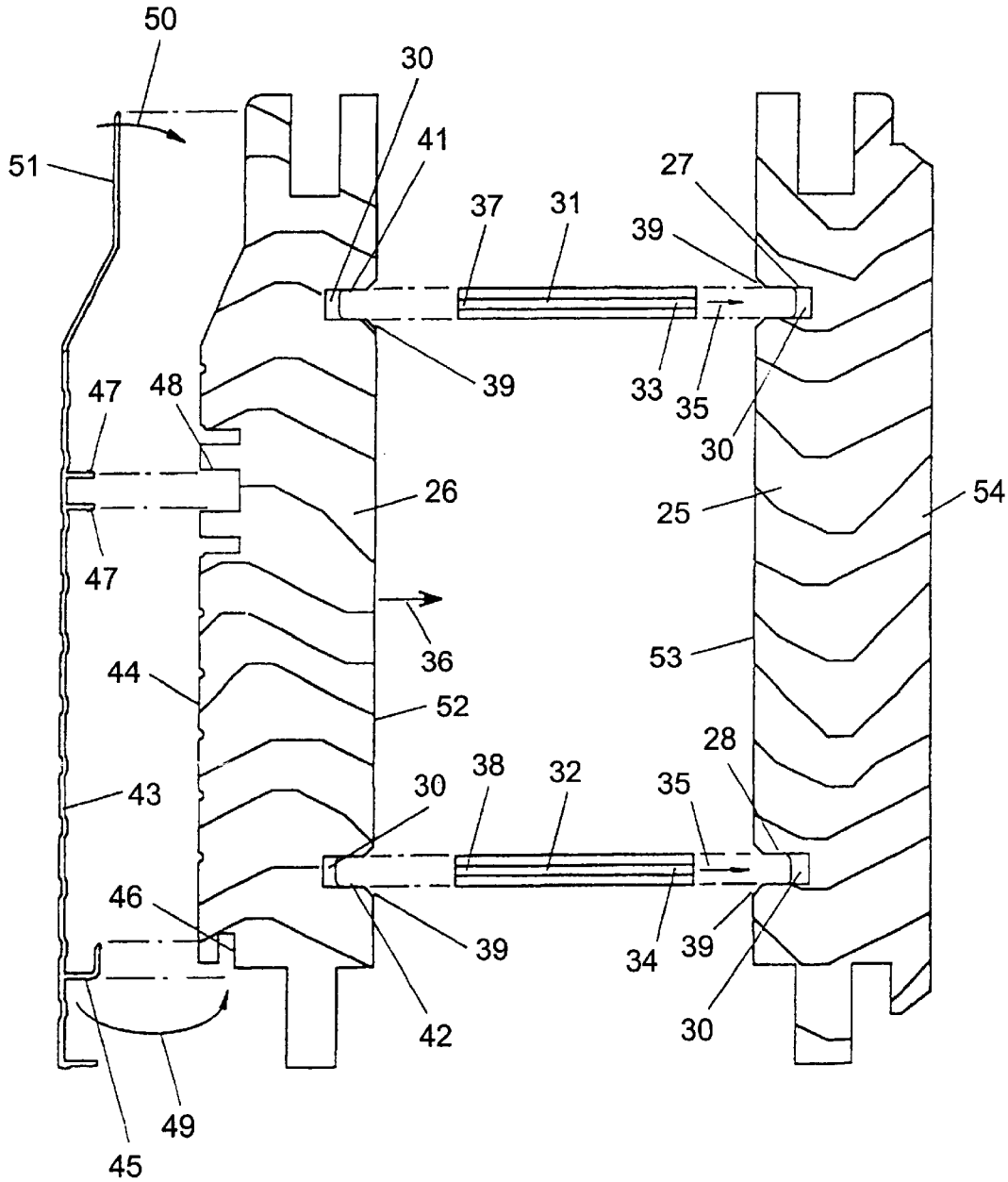
Figure 3A:
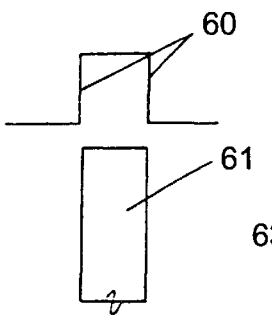
Figure 3B:
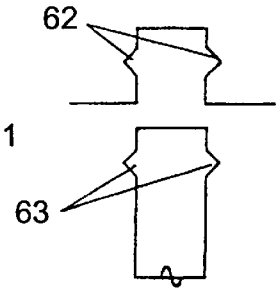
Figure 3C:
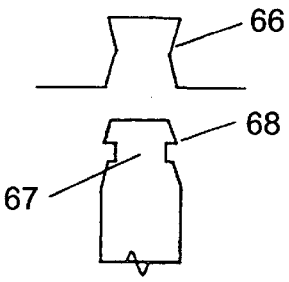
Figure 3D:
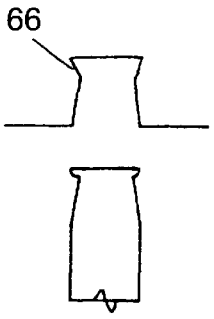
Figure 3E:
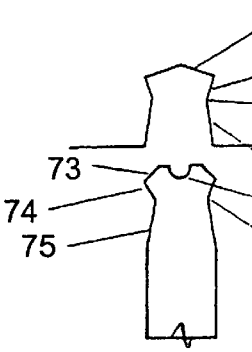
Figure 3F:
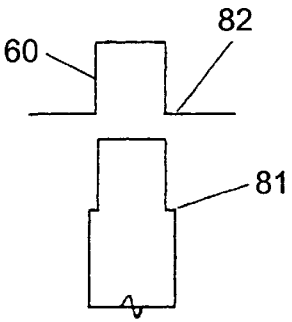
Figure 3G:
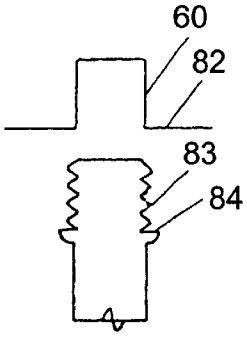
Figure 3H:
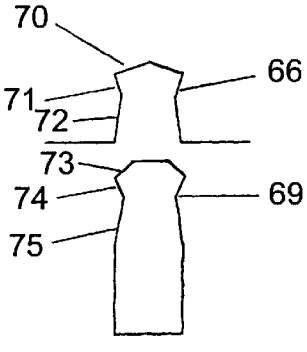
Figure 3K:
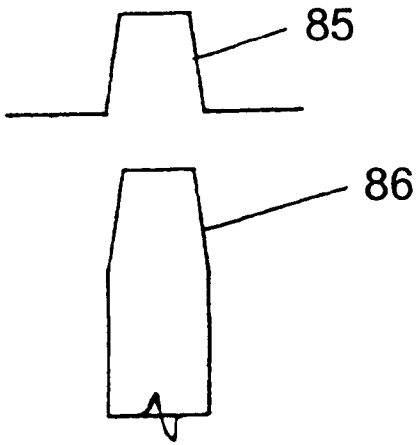
Figure 3J:
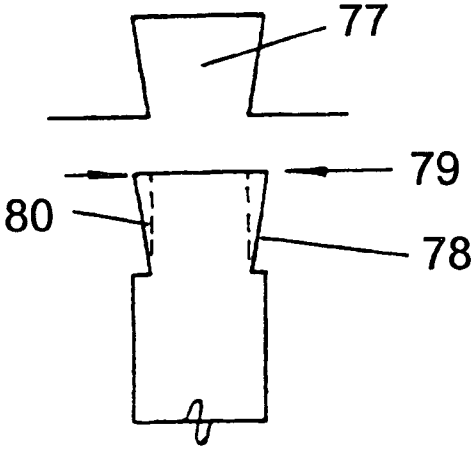
Figure 3I:
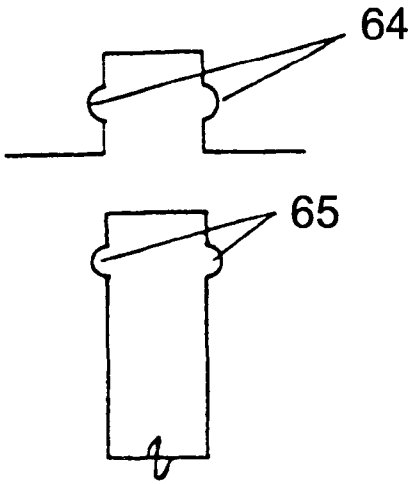
Figure 4:
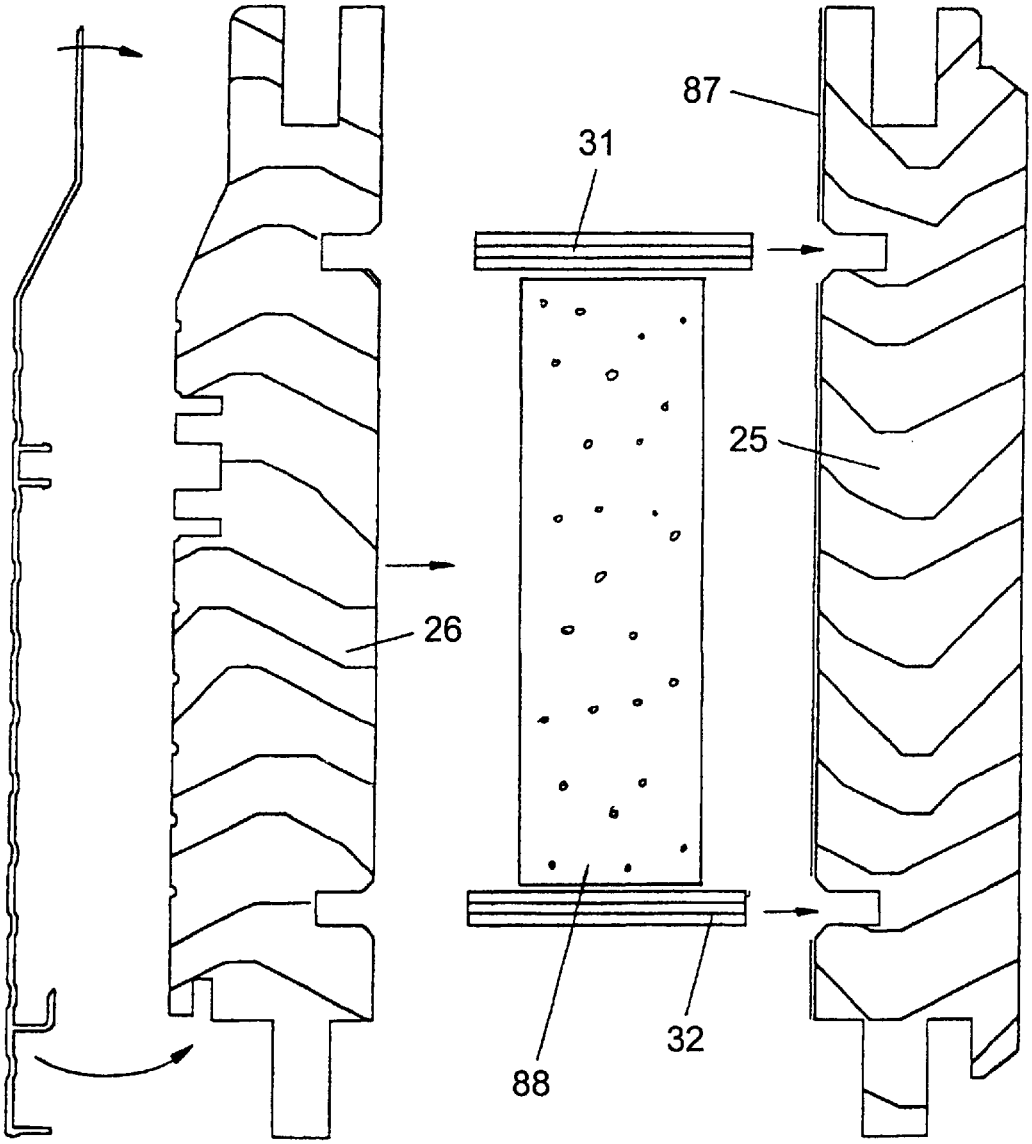
Figure 5:
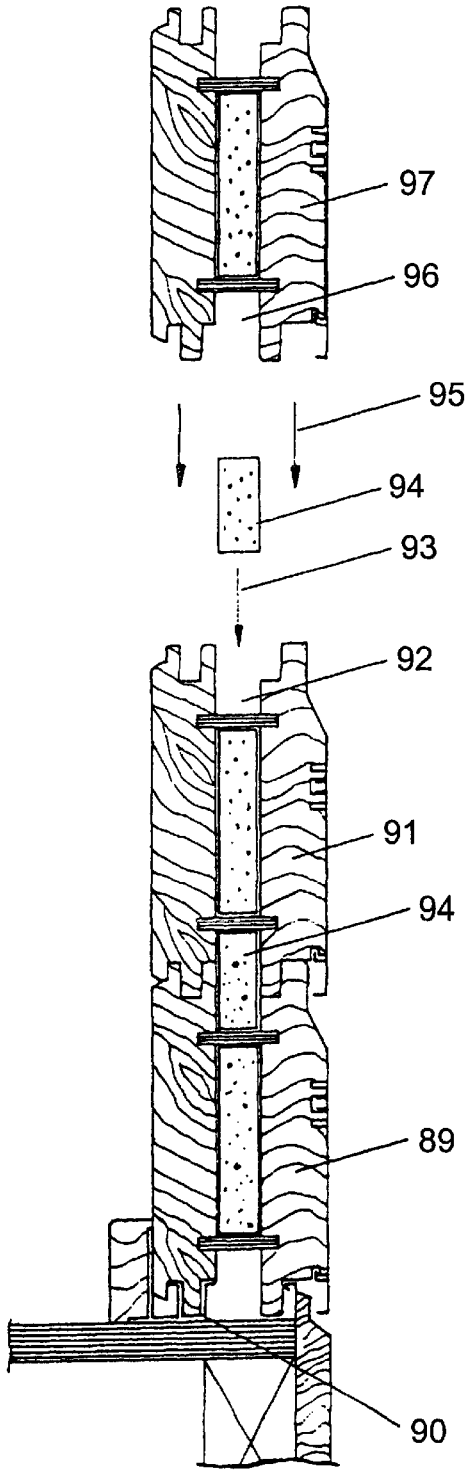
Figure 6:
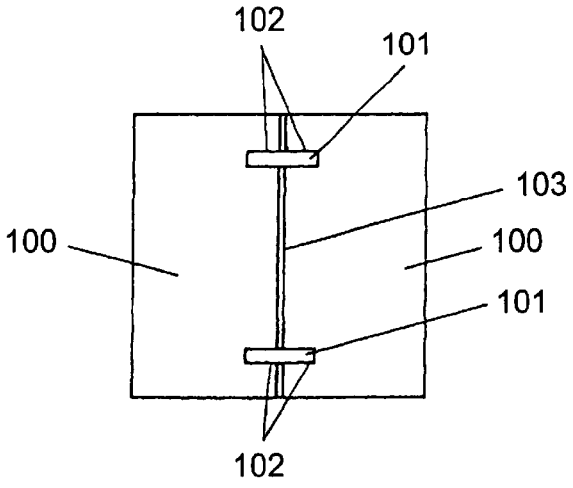
Figure 7:
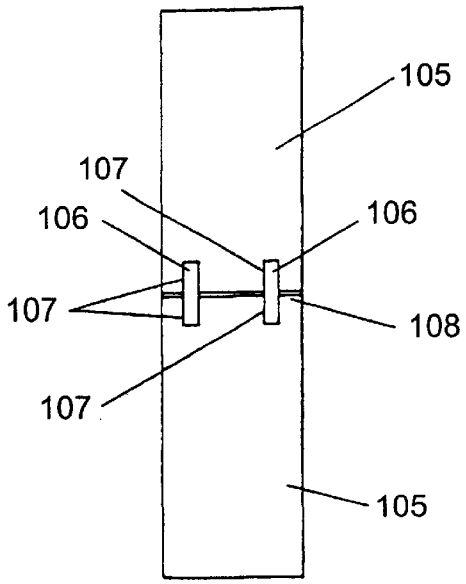
Figure 8:
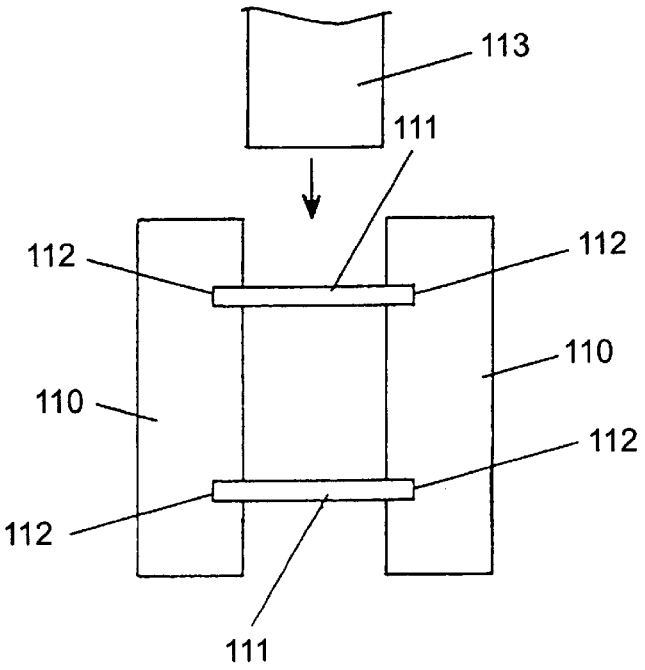
Figure 9:
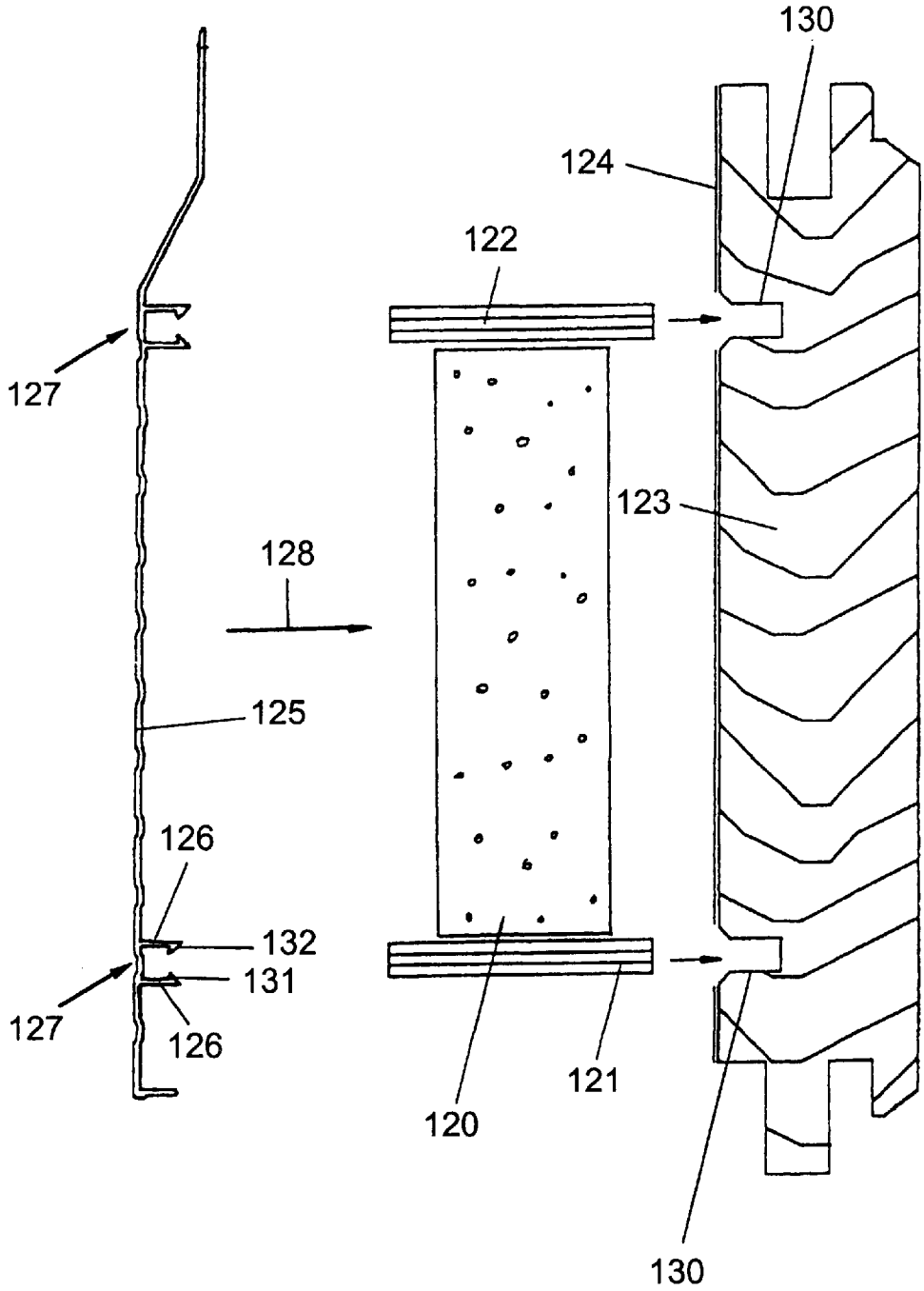

Preferred embodiments of the present invention will now be described with reference to the accompanying drawings in which:

FIG. 1 is a cross sectional end elevation of a building member according to the present invention, FIG. 2 is a cross sectional end elevation in exploded form of another building member according to the present invention demonstrating the construction thereof, FIGS. 3A to 3K show a number of alternative embodiments of the connection of a connecting member edge into a respective channel and a board side face, FIG. 4 shows a cross sectional end elevation in exploded form of another board member according to the present invention including various insulation materials, FIG. 5 shows a cross sectional end elevation demonstrating one construction of a wall using building members such as those in FIG. 4, FIG. 6 shows a cross sectional end elevation of a building member according to the second aspect of the present invention, FIG. 7 shows a building member according to another embodiment of the second aspect of the present invention, and FIG. 8 shows a building member according to the first aspect of the present invention, for particular use as a post or beam, and FIG. 9 is a cross-sectional end elevation of a building member according to a further aspect of the present invention, wherein an aluminium cladding is connected directly to the connecting members.

DETAILED DESCRIPTION OF THE PREFERRED EMBODIMENT

With reference to FIG. 1 a building member 1 is shown which has a pair of boards 3, 4 held in a spaced apart configuration by a pair of connecting members 5, 6. The building member shown is intended for use in forming the wall of a building and the boards 3, 4 are wallboards suitable for that purpose. In the embodiment shown the connecting members 5, 6 comprise narrow strips of plywood or other suitable material and have the elongate edges 10, 11, 12 and 13 respectively secured in longitudinal grooves 14, 15, 16, 17 respectively formed in the opposed side faces 18, 19 of the wallboards 3, 4 respectively.

As will be described later the securement of the edges 10 to 13 in the channels 14 to 17 can be effected by adhesive, formation of the edges and/or channels or both, or any other such means as may be appropriate.

With continued reference to FIG. 1 the building member 1 is intended for use in formation of a wall by edge to edge stacking such as is shown in FIG. 5. To these ends the top and bottom edges of the building member 1 are formed to be readily locatable with one another to engage with the appropriate edge of an adjacent similar building member. In particular the top edge of each wall board 3 or 4 is formed complementary to the bottom edge of that wallboard to thereby mate with the bottom edge of a similar adjacent wallboard. For example, as is shown in FIG. 1 edge 20 is formed complementary to edge 21 and edge 22 is formed complementary to edge 24.

While the building member of FIG. 1 is shown having a pair of connecting members 5, 6, any number of connecting members could be appropriate, although the use of only a single connecting member could allow excessive changes in the separation of the wallboards adjacent the edges thereof potentially reducing the stiffness and strength of the finished wall and may make construction of a wall difficult when connecting edges of adjacent boards.

For ease of manufacture of the building member it is preferred that the channels and connecting members are straight and that essentially the building member has a constant cross section. It would be possible to have the connecting members and channels following a curved, for example sinusoidal, path. However this would significantly increase the difficulty of manufacture and the ability to introduce insulating material into the gap 7 between the two boards 3, 4 in an effective manner.

With reference to FIG. 2 another wallboard is shown in exploded form to demonstrate the method of construction. Wallboard 25 has an outer face 54 which forms the internal wall surface of the building in the completed construction, and an inner side face 53 opposing the inner side face 52 of the second wallboard 26. The outer side face 54 of wallboard 25 is preferably dressed to a high quality as befits an exposed internal wooden wall surface. The opposed inner faces 52 and 53 of the wallboards 25 and 26 respectively may be left undressed as only the outside surface will be exposed or contributes to aesthetic appeal, and the surfaces are not required to mate as would be the case in a more usual laminated building member construction. Leaving these surfaces undressed contributes to a significant reduction in the manufacturing process, and a considerable saving in lost timber.

For additional manufacturing efficiencies and to ensure the dressed surfaces of the product board are not marked by the manufacturing process its is preferred that the boards are left undressed until after assembly, at which time the top and bottom edges and outwardly facing side faces may be machined as desired. Building members might also be supplied in the undressed form for subsequent machining by a building manufacturer.

The inner faces 53, 52 include pairs of channels 27, 28 and 41, 42 thereon. An adhesive 30 is disposed within these channels. Alternatively the adhesive 30 may be disposed along the edges of connecting members 31, 32. Edges 33, 34 of connecting members 31, 32 are introduced into the channels 27, 28 in the direction of arrows 35. The channels may include a chamfer 39, with the edges being tight fitting or oversized for the channels, and being slightly compressed by the chamfer when pressed into the channels.

A liquid adhesive is the preferred material to be used in the channels, however with some forms of the connection (such as illustrated in at least FIG. 3J) it may be sufficient, if the connecting member is formed from plywood or other hydroscopic material is to provide a soakable liquid in the channel to be soaked up by the edge of the connecting member to encourage expansion or re-expansion thereof within the channel.

Board 26 is then pressed toward board 25 in the direction of arrow 36 to introduce the edges 37, 38 of the connecting members 31, 32 into the respective channels 41,42 of the board 26. The presence of a chamfer 39 as already described here serves the additional purpose of assisting to locate the edges 37, 38 into the channels 41, 42. A tight fit of plywood connecting members 31, 32 within the channels substantially reduces the need for a delay during curing of the adhesive 30. Other forms applicable to the edges or channels which achieve a similar purpose will be described later with reference to the FIGS. 3A to 3K.

The building member of FIG. 2 includes an aluminium fascia 43 fitted to the outside 44 of board 26 in the usual manner. The invention is of course not restricted to such aluminium sided building members, and this is given by way of example only. Hooked connecting member 45 is introduced into channel 46 by movement in direction of arrow 49. Top end 51 of the aluminium fascia 43 is rotated in the direction of arrow 50 to introduce barbed flanges 47 into channel 48 to thereby secure the fascia 43 to the board 26.

With further reference to aluminium facias and aluminium siding type embodiments, FIG. 9 depicts a further example of the present invention wherein one of the two members between which the connecting members span is not a wooden board and is in fact an aluminium siding. In FIG. 9 the board 123, which may be lined for example by reflective foil 124 has slots 130 to accommodate the edges of connecting members 121 and 122 in a manner as previously described. Aluminium facia 125 is provided with a pair of connections 127 which extend the length thereof, and are preferably formed integrally in the extrusion of the siding, within which the other edges of the connecting members 121 and 122 engage when the siding is brought together with the board 123 such as depicted by the arrow 128. The connections 127 may for example comprise a pair of perpendicularly extending arms 126 based an appropriate distance apart to have the edge of the connecting member fitted closely therebetween. Each leg may include surface elements to enhance grip, for example edges 131. Preferably the proposed edges 131 of the legs 126 are more closely spaced than the thickness of the connecting members 121 or 122, so that to accommodate the members the legs are required to undergo some elastic deformation, thereby providing a significant residual pressure of the edges 131 against the outer surfaces of the connecting members 121 or 122. To these ends and to enable such assembly with ease the legs are preferably provided with a chamfer 132 which the edges of connecting members 121 or 122 may veer against to force apart the legs 126 when the siding 125 and board 123 are brought together. To improve the insulative qualities a foam block 120, as previously described, is installed within the space enclosed by connecting member 122, board 123, connecting member 121 and siding 125. Providing that the board 123 in this embodiment provide sufficient strength for their application, which will depend on the individual design of building construction being used, in configuration of the board that is chosen, then this embodiment will enable significant reduction in material usage while still achieving the required thermal resistance.

In a still further alternative along these lines, the connecting members may be formed integrally as elongate perpendicular longitudinal extensions from the side face of the fascia. The outer edge of the extension would fit within and engage the slots 130. This would operate similarly to existing aluminium fascia clad board constructions, but the length of the connecting members would leave a substantial insulation gap.

With reference to the assembly processes described above for the building members the manufacturing process has been described as a series of distinct steps. However the manufacturing process may also be achieved in a substantially continuing manner for example, and with reference to the construction shown in FIG. 2 with a rolling press and conveyor so that introduction of the edges of connecting members 31 and 32 into the channels of boards 25 and 26 may be achieved in a generally continuing manner along the longitudinal direction of the building member, and at a given point along the building member the entry of the edges into channels is effected substantially simultaneously.

FIGS. 3A to 3K show a number of different possible configurations for the edges of the connecting members and respective channels into which they are fitted. While connecting members formed from a narrow strip of plywood are preferred at this time, it is also envisaged that suitable connecting members may be formed from extruded or moulded plastic materials. A number of the configurations shown in FIGS. 3A to 3K are clearly more suitable for extruded or moulded connecting members.

With reference to FIG. 3A a connection is shown wherein the connecting member has a rectangular formed edge 61, and the channel has straight parallel sides 60. This connection type is substantially as was described with reference to FIG. 2. This connection is clearly suitable for use with a plywood connecting member, and with a plywood connecting member may be enhanced if the plywood connecting member is slightly larger in thickness than the channel and the edge 61 thereof may be compressed to fit within the channel prior to entry into the channel to expand once it is placed therein. Such expansion may be enhanced by a soaking up of a liquid in the channel, for example water applied specifically for the purpose or indeed a liquid adhesive.

FIGS. 3F, 3G and 3K depict variations of the connection method of FIG. 3A. FIG. 3F shows a rebated edge region of the connecting member which upon full insertion into the channel 60, provide additional strength against bending by action of the shoulders 81 against the side face surfaces 82.

In FIG. 3G the connecting member is formed with a series of corrugations on the parallel faces thereof adjacent the edge, the corrugations 83 to assist in grip against the inside facing surfaces 60 of the channel, and also with shoulders 84 which on full insertion act against the side faces 82 in like manner as described in FIG. 3F. The connecting member of FIG. 3G is clearly more appropriately formed by extrusion or moulding than from plywood materials.

With reference to FIG. 3K a configuration is shown where the channel includes divergent faces 85 with the edge portion of the connecting member including complementary faces 86. The connection of this configuration is suitable for frictional engagement and adhesive bonding. The configuration is most applicable where self alignment of the connecting member into the channel is of prime concern, for example in a continuous manufacturing process or similar. This embodiment sacrifices the ability to have secure connection without adhesive or prior to adhesive curing, for ease of manufacturing. Clearly the connection of this configuration could be extruded, moulded or formed from wooden materials such as plywood, or any other appropriate material.

With reference to FIG. 3B the connection includes a square sided channel including notches 62 formed longitudinally along the side faces thereof from and into which longitudinal protuberances 63 adjacent the edge of and located on the upper and lower faces of the connecting member may engage. A similar embodiment is depicted in FIG. 3I with longitudinal grooves 64 and protrusions 65. The difference between these embodiments is the shape of the grooves and protuberances. In FIG. 3B the grooves and protuberances are of a triangular type configuration, which may allow for example the formation of the grooves 62 by a pair of angled saw blades following a vertical channel cutting saw blade. This is in contrast to the embodiment of FIG. 3I which shows rounded grooves and protuberances, the grooves being most easily formed by routing following the cutting of the channel. In any case for this form, an extruded or moulded connecting member would be most appropriate given their longitudinal protrusions that are formed thereon. It should also be appreciated that the grooves and protrusions could be swapped with the channel including the protuberances and the connecting member edge including the grooves.

With reference to FIGS. 3C to 3E and 3H configurations of connecting member edge and channel are shown wherein the channel includes a narrowed neck 66 and the respective engaging edge of the connecting member is formed to engage in the channel by pushing past the neck and having the neck engage in a narrow part of the connecting member edge.

With reference to FIG. 3C the connecting member edge includes a tapered button like portion joined to the member by a narrowed ridge 67, the trailing edge 68 of the button being wider than the neck 66. In engagement the button is pushed passed the neck 66 and the neck 66 engages within grooves formed by the narrowed ridge 67.

A very similar embodiment is shown in FIG. 3D except that no specific ridge is formed in the edge of the connecting member, there being only an expanded button like end with rounded corners to force past the neck 66 and have the neck 66 engage there behind. Connecting members of these types would best be formed of any extruded plastic or aluminium material to reduce the risk of the formed edges of the connecting member being damaged during assembly.

FIGS. 3E and 3H show embodiments wherein the connecting member edge shows more secure engagement and location within the channel, the neck 66 of the channel engaging with a similar neck 69 of the connector, and angled surfaces 70, 71 and 72 of the channel abutting similar and complementary angled surfaces 73, 74 and 75 of the connecting member edge. The angled surfaces allow the connecting edge to push past the neck 66 and locate the expanded end formed by angled surfaces 73 and 74 within the chamber formed by angled surfaces 70 and 71. The embodiment of FIG. 3E includes the additional provision of a groove or channel 76 running along the edge face of the edge of the connecting member to allow easier compression of the expanded end to fit past the neck 66.

With reference to FIG. 3J another embodiment incorporating the necked idea is shown involving a dovetail channel 77 and generally dovetail edge 78 of the connecting member formed to fit snugly within the dovetail channel 77. For fitting into the channel 77 the dovetailed edge 78 is preferably compressed as depicted by arrows 79 to conform to a rectangular end configuration as depicted by broken lines 80. While in the compressed condition 80 the edge is inserted into the dovetail channel 77 and therein is allowed to expand, and such expansion may be assisted by the presence of a liquid such as water or maybe the adhesive if so desired. Although the dovetailed edge 78 may be formed as an expansion of the edge region of the connecting member it is preferred that it be formed in a recessed manner so that the connecting member can be manufactured from a wooden material such as plywood without excessive waste in material. Alternatively the connecting member may comprise a square ended approach such as in FIG. 3A, compressed to conform to the contours as depicted by broken lines 80, and inserted into the dovetailed channel 77 to therein expand to conform to the configuration depicted as 78, not requiring the preformation of a dovetail along the edge of the connecting member.

It will be appreciated that a multitude of other configurations for the channel and connecting edge could be envisaged and that the ones depicted are examples only any of but may be considered as further aspects to the invention in that many provide unique advantages, but are often accompanied by difficulties in their formation with associated additional costs. Consequently it is considered that for most purposes the simple connection of FIG. 3A will be sufficient and most cost effective.

With reference to FIG. 4 the exploded view depicted demonstrates the application of additional insulating materials to the building member of the present invention. In particular insulation may include a layer of reflective foil 87 bonded to the board 25 prior to assembly. Alternatively a block of insulating material 88 such as polyurethane foam or polystyrene foam may be incorporated in the cavity formed by boards 25, 26 and connecting members 31, 32. The insulating block 88 may be inserted at the time of assembly of the boards and connecting members, or may be slid into the cavity from an end thereof subsequent to assembly.

One method for assembly of a wall from the building members of the invention, and particularly as depicted in FIG. 4 is demonstrated in FIG. 5. The wall is assembled by stacking of building members such as 89, 91 and 97 in an edge to edge configuration, with the respective edges thereof engaged. The bottom building member such as 89 may be supported alongside the edge of the floor and located by an extrusion 90 secured thereto. Any other methods of securing the bottom wallboard will suggest themselves to persons skilled in the art and most conventional methods would be easily applicable or adaptable.

For optimum insulation properties additional blocks of insulating material 94 are incorporated in the cavities formed between adjacent building members and associated connecting members. As an example of an assembly the block 94 is inserted in the direction of arrow 93 into the space 92 formed between the spaced apart boards of building member 91, above the uppermost connecting member thereof, before the building member 97 is located on top of the building member 91 in the direction of arrows 95, with the boards thereof engaging the boards of the building member 91, to further enclose the block 94 within space 96.

Alternative methods are of course possible, for example the wall may be constructed from a sequence of parallel vertically disposed building members, rather than horizontal.

The present invention is believed to greatly improve the insulating properties of building members for use in solid timber type constructions. In particular the thermal resistance of a building member incorporating the spaced apart boards shows an increase of approximately 30% over a solid timber building member. With the further inclusion of polystyrene insulating materials the improvement over solid wood is approximately 100%. A similar level of improvement is noted with a layer of applied reflective foil rather than the polystyrene insulating material. If polyurethane foam is included within the insulation space rather than polystyrene or the reflective foil the improvement over solid wood building members is approximately 150%.

Furthermore the building members are of similar weight, incorporate more retained overall volume of wood, thereby leading to lower raw material costs, reduce wastage and processing time by the elimination of two dressing operations and a lamination operation, although the savings are somewhat offset by the additional assembly costs in manufacturing fitting the connecting members within the channels. It is however envisaged that boards according to the invention will be of similar price to those presently available notwithstanding the greatly improved thermal properties.

It will also be appreciated that the building members of the present invention as already described may find application other than in the construction of walls and for example would also be readily appropriate for thermal insulated tongue and groove flooring or sarking.

A further application for buildings according to the present invention is demonstrated with respect to FIG. 8. The building member shown is very similar to the building member of FIGS. 1 to 5, but lacking the tongue-in-groove configurations associated with the individual board edges. The building member of FIG. 8 is intended more for use as a post or beam type building member, rather than for edge-wise connection to other such building members. In other respects the boards 110, connecting members 111 and channels 112 providing engagement, are essentially the same as have already been described. Construction of the building member of FIG. 8 would also be completed substantially according to the methods as previously described, and it is in the methods of construction and in the savings of wood and weight that the advantages of this building member lie. In particular the construction methods incorporating the connecting members 111 eliminate the need for a laminated plank construction, and associated pressing operations. In a post configuration the member as shown in FIG. 8 may also serve to locate ends of internal walls, for example in the channel provided by the inside faces of the pair of boards and an outwardly facing face of a connecting member, such as depicted by the insertion of wall board 113.

The advantages of construction simplicity as referred to above in respect to FIG. 8 are also the prime consideration in the building members embodied in FIGS. 6 and 7. Here the connecting member and channel construction is used primarily as a means to eliminate the need for sustained pressing during the lamination process, with the connecting members themselves providing the necessary location during curing of the adhesive.

With particular reference to FIG. 6, a building member is shown in which two boards 100 are joined with the broader long faces abutting, and a pair of spaced apart connecting member 101 being provided within channels 102. An adhesive 103 may also be provided, but with the interconnection provided by the connecting members 101 in many cases this will not be necessary. The building member of FIG. 6 is configured primarily to act as a post or other low aspect ratio member. FIG. 7 on the other hand shows wall boards 105 abutting on their narrower long faces and connected by connecting members 106 within channels 107. An adhesive 108 may be located along the boundary therebetween. This member is of course suited towards higher aspect ratios such as beams and the like.

These constructions find their advantage in the elimination of the pressing stages of the construction process, along with the ability of the connecting members to accurately locate the boards 100 or 105 with respect to one another and thereby allow full dressing of the boards prior to assembly. Prior assembly methods generally necessitated dressing the faces to abut prior to lamination and dressing the exterior subsequent to lamination. With the construction method as depicted in FIGS. 6 and 7 that is overcome. It will be readily appreciated that even though only rectangular shapes are depicted in the figures, other profiles and shapes may be applied to the boards before adhering one to the other.

What is claimed is:

1. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, each said first and second member comprising a wooden board and each said board having its edge faces formed to facilitate connection of one said edge to the other said edge of an adjacent similar board, or an adjacent similar said building member, said building member having two parallel said connecting members spaced apart in said insulation space, the edges thereof being secured in a pair of parallel said channels in each of said side faces, said connecting members and said boards together defining a longitudinal cavity, a block of insulating material being disposed within said longitudinal cavity.

2. A building member as claimed in claim 1 wherein said opposed side faces of said first and second boards are substantially undressed.

3. A building member as claimed in claim 1 wherein each said channel comprises a straight sided rectangular cut and said connecting member has rectangular edges complementary to said cut.

4. A building member as claimed in claim 1 wherein each said channel comprises a straight sided rectangular channel with a small recess provided in each side wall thereof along the length thereof, said edges of said connecting member being provided with complementary ridges on the upper and lower faces thereof adjacent the edge thereof to engage within said recesses.

5. A building member as claimed in claim 1 wherein said channel comprises a channel having walls initially inwardly angled to a neck and thereafter outwardly angled to the base of said cut and said edges of said connecting member include a taper and subsequent expansion adjacent the edge thereof, the expansion when fitted being past the neck of said channel to thereby engage the connecting member edge within the channel.

6. A building member as claimed in claim 1 wherein said channel comprises a dove-tailed rebate, and the edges of said connecting member are formed with a complementary dove-tail thereon fitted within said dove-tail groove.

7. A building member as claimed in claim 1, wherein said insulating material comprises a block of polystyrene or polyurethane foam inserted into the space bounded by the first and second members and pair of parallel connecting members once constructed.

8. A building member as claimed in claim 1, wherein said insulating material comprises reflective insulating foil applied across the opposed face of one of said first or second members.

9. A method of constructing a building member from a pair of boards and at least one connecting member, the boards incorporating on faces thereof channels to accommodate the edges of said at least one connecting member, said method includes:

a) in no particular order, the steps of:

applying a wood soakable liquid into a corresponding said channel of each board, and compressing at least the edge regions of said connecting member along the length thereof to be inserted within said channels, and b) the subsequent step of inserting said edges of said connecting member into said corresponding channels such that in the presence of said wood soakable liquid said compressed edges are encouraged to swell and locate said edges securely within said channel.

10. A method of constructing a building member as claimed in claim 9 wherein said wood soakable liquid comprises a liquid adhesive.

11. A building member as claimed in claim 9 wherein said edges of said connecting member are initially formed with a dove-tail which is compressed to a rectangular end to fit past the narrowed neck of a dove-tail channel and thereafter expand to fill said channel.

12. A method of constructing a building member as claimed in claim 9 wherein said channels have a dove tail form with a narrowed neck, and the rectangular edges of said connecting member are compressed to pass said narrowed neck and into said channel to thereby expand and fill said channel, said connecting member remaining over-compressed in the region of said narrowed neck.

13. A method of constructing a building member as claimed in claim 9 wherein said boards are initially in an undressed state, and including subsequent to said insertion, the step of dressing at least the top and bottom edges of said boards, including forming complementary tongue and groove configurations thereon.

14. A method of constructing a wall from building members each building member comprising spaced apart first and second members each having a pair of end faces defined by their depth and breadth, a pair of edges defined by their length and thickness and a pair of side faces defined by their length and depth, for each board the said thickness being less than the said depth and the said length being less than the said length at least one said member comprising a board, a side face of said first member and a side face of said second member opposed and separated by an insulation space, and at least one connecting member bridging between said opposed side faces of said first and second members, extending and parallel with substantially the entire length thereof, an edge of said connecting member being secured within a channel in and running the length of one said opposed side face and the other edge thereof being rigidly connected to the other said opposed side face to hold and secure said members in said spaced apart configuration, said method includes stacking a plurality of said building members in an edge to edge configuration with edge faces of said first and second boards engaged with corresponding opposed edge faces of the first and second boards of adjacent building members, before stacking each further said building member placing a block of insulating material within the channel formed between said first and second boards, on top of the uppermost connecting member, and extending above the level of the upper edges of said first and second boards to protrude into the channel between the first and second boards of an upwardly adjacent building member to reach or nearly reach the lowermost connecting member thereof.

15. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, and one of said members being an extruded profile, said extrusion having an outwardly facing side and an inwardly facing side opposing said other of said first and second members, a pair of closely spaced perpendicularly extending legs of said profile extending perpendicularly from said inwardly facing side of said profile, forming, in said extrusion, a pair of parallel closely spaced flanges running the length of said extrusion and extending into said insulation space toward said opposing member between which the edge of said connecting member is engaged.

16. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, and one of said members being an extruded profile, said extrusion having an outwardly facing side and an inwardly facing side opposing said other of said first and second members and each said connecting member comprises a leg of said extruded profile extending substantially perpendicularly from the inwardly facing face thereof, forming, in said extrusion, a flange running the length thereof and extending into said insulation space toward said opposing member, the edge of each said flange being engaged within a channel of the other said spaced apart member.

17. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, each said channel comprising a straight sided rectangular cut and said connecting member having rectangular edges complementary to said cut.

18. A building member as claimed in claim 17 wherein said connecting member comprises a strip of rigid material, the edges of which are at least initially compressed for fitting within said channels in said opposed faces of said first and second boards to thereafter expand and engage within said channels.

19. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, p1 each said channel comprising a straight sided rectangular channel with a small recess provided in each side wall thereof along the length thereof, said edges of said connecting member being provided with complementary ridges on the upper and lower faces thereof adjacent the edge thereof to engage within said recesses.

20. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, said channel comprising a channel having walls initially inwardly angled to a neck and thereafter outwardly angled to the base of said cut and said edges of said connecting member including a taper and subsequent expansion adjacent the edge thereof, the expansion when fitted being past the neck of said channel to thereby engage the connecting member edge within the channel.

21. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, said channel comprising a dove-tailed rebate, and the edges of said connecting member being formed with a complementary dove-tail thereon fitted within said dove-tail groove.

22. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, one of said members being an extruded profile, said extrusion having an outwardly facing side and an inwardly facing side opposing said other of said first and second members, a pair of closely spaced perpendicularly extending legs of said profile extending perpendicularly from said inwardly facing side of said profile, forming, in said extrusion, a pair of parallel closely spaced flanges running the length of said extrusion and extending into said insulation space toward said opposing member between which the edge of said connecting member is engaged.

23. A building member comprising spaced apart first and second members each having a pair of end faces defined by their depth and breadth, a pair of edges defined by their length and thickness and a pair of side faces defined by their length and depth, at least one said member comprising a board, for each said board the thickness being less than the depth and the depth being less than the length, a side face of said first member and a side face of said second member opposed and separated by an insulation space, and at least one connecting member, each said connecting member bridging between said opposed side faces of said first and second members, extending substantially the entire length thereof, and running parallel therewith, an edge of each said connecting member being secured within a channel in and running the length of one said opposed side face and the other edge thereof being rigidly connected to the other said opposed side face to hold and secure said members in said spaced apart configuration, one of said members being an extruded profile, said extrusion having an outwardly facing side and an inwardly facing side opposing said other of said first and second members and each said connecting member comprises a leg of said extruded profile extending substantially perpendicularly from the inwardly facing face thereof, forming, in said extrusion, a flange running the length thereof and extending into said insulation space toward said opposing member, the edge of each said flange being engaged within a channel of the other said spaced apart member.

* * * * *